US008250984B2

(12) United States Patent
Paulic et al.

(10) Patent No.: US 8,250,984 B2
(45) Date of Patent: Aug. 28, 2012

(54) MINE-DEFEATING SUBMUNITION

(75) Inventors: Antonio Paulic, Arlington, VA (US); Lance Benedict, McLean, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 390 days.

(21) Appl. No.: 12/550,776

(22) Filed: Aug. 31, 2009

(65) Prior Publication Data

US 2010/0050898 A1 Mar. 4, 2010

Related U.S. Application Data

(60) Provisional application No. 61/092,955, filed on Aug. 29, 2008.

(51) Int. Cl.
*F42B 12/58* (2006.01)

(52) U.S. Cl. ..... 102/489; 102/221; 102/237; 102/238; 102/244; 102/481

(58) Field of Classification Search ..... 102/221, 102/237, 238, 239, 241, 244, 245, 254, 256, 102/473, 481, 489, 499, 500
See application file for complete search history.

(56) References Cited

U.S. PATENT DOCUMENTS 3,786,754 A * 1/1974 Donahue et al. ..... 102/238
4,436,035 A * 3/1984 Strandli ..... 102/364
4,480,551 A * 11/1984 LoFiego ..... 102/245
5,076,171 A * 12/1991 Altenau et al. ..... 102/489
5,164,533 A * 11/1992 Schluckebier ..... 86/20.14
5,243,912 A * 9/1993 Ziemba ..... 102/235
5,686,692 A * 11/1997 Watson, Jr. ..... 102/352
5,760,330 A 6/1998 Himmert et al.
6,257,145 B1 * 7/2001 Wardecki ..... 102/204
6,540,175 B1 4/2003 Mayersak et al.
6,604,467 B2 * 8/2003 Alculumbre et al. ..... 102/249
6,640,719 B1 * 11/2003 Pacella et al. ..... 102/277.1
7,168,367 B2 * 1/2007 Levy et al. ..... 102/489
7,343,860 B2 3/2008 Michel et al.
7,415,930 B2 8/2008 Raphelt et al.
8,042,471 B2 * 10/2011 Michel et al. ..... 102/275
8,047,135 B1 * 11/2011 Paulic et al. ..... 102/216
2008/0011179 A1 * 1/2008 Michel et al. ..... 102/275
2010/0031841 A1 2/2010 Michel et al.
2010/0237186 A1 9/2010 Fu et al.
2010/0307326 A1 * 12/2010 Paulic ..... 89/1.13
2011/0252996 A1 * 10/2011 Paulic et al. ..... 102/399

* cited by examiner

*Primary Examiner* — Gabriel Klein
(74) *Attorney, Agent, or Firm* — Howard IP Law Group, PC

(57) ABSTRACT

In accordance with an embodiment of the invention, a submunition is contemplated having a submunition body, an explosive payload housed within said submunition body and an elongated delay member housed within the submunition body, the elongated delay member coated with at least one reactive material that provides a controlled time delay between submunition impact and detonation of the explosive payload. The submunition may also comprise an elongated pendulum having a hollow core sized to receive said elongated delay member, the elongated pendulum adapted to be movable between a locked position that mitigates likelihood of inadvertent detonation of the explosive payload and an unlocked position that enables detonation of the explosive payload.

16 Claims, 6 Drawing Sheets

MINE-DEFEATING SUBMUNITION

CROSS-REFERENCE TO RELATED APPLICATIONS

This application claims priority under 35 USC 119(e) to Provisional Patent Application Ser. No. 61/092,955 entitled Pendulum Safe and Arm With Reactive Nano-Coated Rod Delay filed Aug. 29, 2008, the subject matter thereof incorporated by reference in its entirety.

FIELD OF THE INVENTION

The present invention relates generally to submunitions, and particularly to small-scale submunitions used in land-mine destruction applications.

BACKGROUND

The use of submunitions capable of individually defeating land mines has proven to be a successful method of neutralizing mines within a coverage area. It is desirable to increase the range of the coverage area, however in order to accomplish a larger coverage area more submunitions must be released from a fixed-size dispenser. Accordingly, the size of these submunitions must be decreased. However, submunitions of such small scale that are capable of individually defeating land-mines and also incorporate a safe and arm mechanism are currently unavailable. Improvements to mine-defeating submunitions are thus desired.

SUMMARY

In accordance with an embodiment of the invention, a submunition is contemplated having a submunition body, an explosive payload housed within the submunition body, an elongated delay member housed within the submunition body, the elongated delay member coated with at least one reactive material that provides a controlled time delay between submunition impact and detonation of the explosive payload.

The submunition may also comprise an elongated pendulum having a hollow core sized to receive the elongated delay member, the elongated pendulum adapted to be movable between a locked position for mitigating likelihood of inadvertent detonation of the explosive payload and an unlocked position for enabling detonation of the explosive payload, the elongated pendulum being substantially out of line with a longitudinal axis of the submunition when in the locked position and substantially in line with a longitudinal axis of the submunition when in the unlocked position.

In accordance with another embodiment of the invention, a safe and arm apparatus is contemplated having an elongated pendulum having at a first end at least one transverse protrusion and a lock indicator protruding from a top surface of the elongated pendulum, a pendulum housing, the pendulum housing sized to fit within a submunition housing and having a cutout section shaped to receive the elongated pendulum and to allow the at least one transverse protrusion of the elongated pendulum to pivot about one end of the pendulum housing In accordance with another embodiment of the invention, a delay mechanism for delaying detonation of a projectile is contemplated comprising an elongated delay member, the elongated delay member having a forward end coated with a first reactive material, the reactive material adapted to ignite upon kinetic impact, an aft end having a thermite coating, and an elongated section coated with a second reactive material, the second reactive material adapted to burn from the forward end to the aft end upon the forward end receiving the kinetic impact.

In accordance with another embodiment of the invention a submunition dispenser is contemplated comprising a dispenser housing and a plurality of submunitions bundled within the dispenser housing, each submunition having a submunition housing and a safe and arm apparatus having a lock indicator protruding through an outer surface of the submunition housing, the lock indicator mitigating likelihood of detonation of the submunition when depressed. The bundled submunitions may be arranged such that either an internal surface of the dispenser housing or the external surface of one of the plurality of submunitions exerts a force on the lock indicator of each of the plurality of submunitions.

DETAILED DESCRIPTION OF PREFERRED EMBODIMENTS

Reference will now be made in detail to the present exemplary embodiments of the invention, examples of which are illustrated in the accompanying drawings.

Figure 1A:
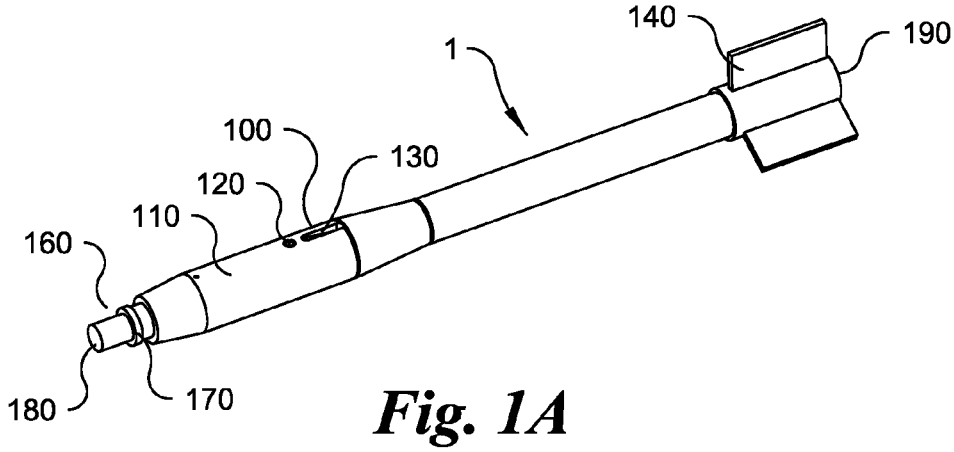
FIG. 1A is a diagram illustrating a perspective view of a submunition configured with a safe and arm in a safe or locked mode according to an exemplary embodiment.
Figure 1B:
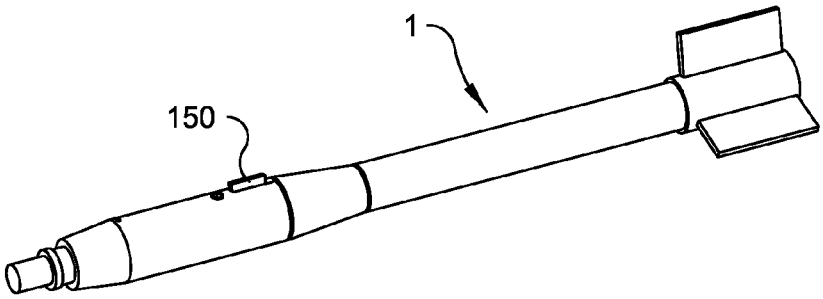
FIG. 1B is a diagram illustrating a perspective view of the submunition of FIG. 1A configured with the safe and arm in an armed or unlocked mode.

FIG. 1A illustrates a perspective view of an exemplary submunition 1 in a safe or locked mode in accordance with an exemplary embodiment of the invention. FIG. 1B illustrates a perspective view of the exemplary submunition 1 in an armed or unlocked mode. As shown in FIG. 1A the submunition 1 has a dart-style design and comprises a submunition housing 100 which includes a body 110, a tail 140, and a screw cap (not shown) located at an aft end 190 of the body 110. By way of example, the body 110 and tail 140 may be comprised of S-7 tool steel. A triggering mechanism 160 is disposed at a forward end of the housing 100 and is partially housed within a forward chamber of the housing 100. The triggering mechanism 160 comprises a triggering sleeve 170 and a standoff pin 180. By way of example, the triggering sleeve 170 and standoff pin 180 may be comprised of S-7 tool steel. A slot 130 is disposed along a longitudinal axis of the body 110 of the housing 100 for allowing a lock indicator 150 of a safe and arm mechanism to visibly protrude through the body 110 of the housing 100. FIG. 1A shows the lock indicator 150 below the surface of the body 110 of the submunition housing 100. This position visually indicates that the submunition 1 is in a locked or safe mode. FIG. 1B shows the lock indicator 150 extending from slot 130 a given distance above the surface of the body 110 of the housing 100. This position visually indicates that the submunition 1 is in an unlocked or armed mode.

Figure 2A:
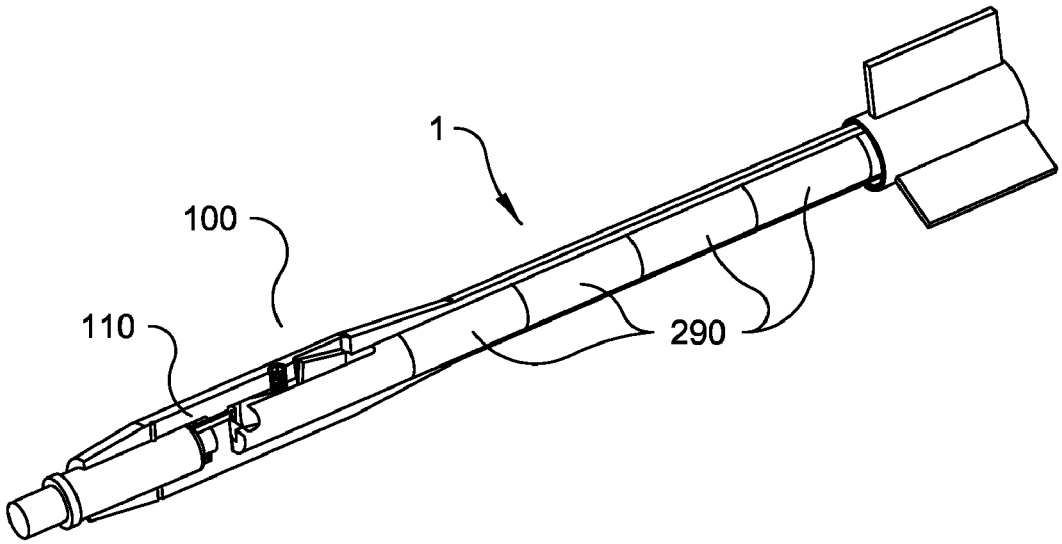
FIG. 2A is a diagram showing a split view of the submunition of FIG. 1A.
Figure 2B:
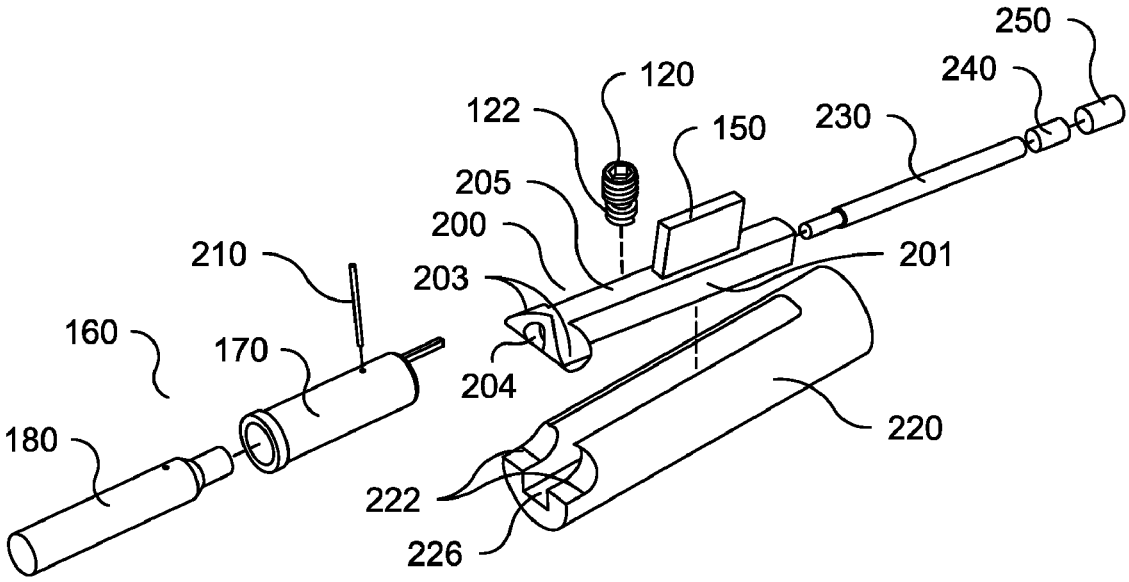
FIG. 2B is a diagram showing an exploded view of the submunition of FIG. 1A.

FIG. 2A illustrates a split view of the exemplary submunition 1 of FIG. 1A while FIG. 2B illustrates an exploded view of components of the submunition 1 involved in a triggering sequence. The body 110 of the submunition 1 has an internal diameter of approximately 0.25 inches, an external diameter of approximately 0.44 inches and is approximately 5-6 inches in overall length. The triggering mechanism 160 is housed partially within the forward chamber of the submunition housing 100 at a forward end of the body 110. The triggering mechanism 160 further comprises a cylindrical standoff pin 180 coupled to a triggering sleeve 170 by way of a shear pin 210 inserted radially through apertures in both the triggering sleeve and a portion of the standoff pin 180 housed within the triggering sleeve. By way of example, the shear pin 210 may be comprised of S-7 tool steel or stainless steel 303. The submunition 1 also includes a safe and arm pendulum 200 that comprises an elongated member 201 having two cylindrical protrusions 203 dimensioned to mate with the cylindrical cutouts 222 of the safe and arm pendulum housing 220. By way of example, the safe and arm pendulum 200 may be comprised of S-7 tool steel. The safe and arm pendulum 200 further comprises a hollowed cylindrical core 204 dimensioned to receive a cylindrical rod delay 230 coated with a reactive material. Applicant has recognized that existing safe and arm mechanisms are not sized to fit within small-scale submunition housings. Integration of the rod delay 230 into the safe and arm pendulum 200 allows for a desirable reduction in scale of the submunition 1. The safe and arm pendulum 200 further comprises a lock indicator 150 extending from a top surface 205 of the safe and arm pendulum. In the exemplary embodiment the lock indicator 150 is of a tab shape but may be of any suitable shape or size to act as a visual indicator and to receive an external force. The submunition 1 also includes a safe and arm pendulum housing 220 which is an elongated cylindrical member having a longitudinal rectangular cutout 226 adapted to receive safe and arm pendulum 200. By way of example, the safe and arm pendulum housing 220 may be comprised of S-7 tool steel. The rectangular cutout 226 is dimensioned to allow the safe and arm pendulum 200 to pivot around the cylindrical cutouts 222. By way of example, the safe and arm pendulum 200 may have a range of motion of approximately 10 degrees however the range of motion may vary as function of the size of the submunition device. The safe and arm pendulum 200 further comprises a spring lock 120 mounted within the body 110 of the submunition 1 and having a spring 122 extending within the forward chamber of the housing 100 and applying a force on the top surface 205 of the safe and arm pendulum 200. By way of example, the spring lock 120 may be comprised of S-7 tool steel. At the aft end of the safe and arm pendulum 200, the hollowed cylindrical core 204 is dimensioned to receive a sensitive explosive 240 and a cup 250. By way of example, the cup 250 may be comprised of S-7 tool steel or stainless steel 303. The cup 250 is responsible for initiating detonation of the high explosive payload, the high explosive payload comprising explosive pellets 290 which are housed within the aft chamber of the housing 100. By way of example, the explosive pellets 290 may be comprised of PBXN-05 or similar high explosive material.

Referring now to FIG. 3A, FIG. 3B, FIG. 3C and FIG. 3D, diagrams are shown illustrating cross-section views of the submunition of FIG. 1A. As shown, the components of the submunition housing 100 are held in place by a fastener 310 which is inserted into the aft end 190 of the body 110 of the submunition housing 100. In the exemplary embodiment the fastener 310 is a screw cap but it is to be understood that any type of fastener or plug suitable for securing the contents of the submunition housing 100 may be used.

Operation of The Safe and Arm Pendulum Mechanism

Referring back to FIG. 2B, the submunition 1 of the present embodiment comprises a locking mechanism with two distinct modes. In the armed or locked mode the safe and arm pendulum 200 may be in a first position wherein the rod delay 230, sensitive explosive 240 and cup 250 are in line with the additional components of the triggering sequence thereby allowing the triggering sequence to occur and ultimately allowing detonation of the explosive payload 290. In the safe or unlocked mode the safe and arm pendulum 200 may be in a second position wherein the rod delay 230, sensitive explosive 240 and cup 250 are out of line with the components of the triggering sequence thereby mitigating the likelihood of inadvertent detonation of the explosive payload 290. The operation of the safe and arm pendulum 200 will now be described in further detail.

Figure 3A:
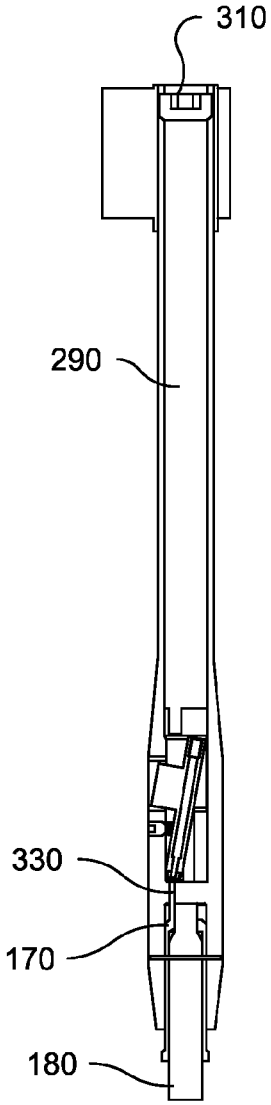
FIG. 3A is a diagram showing a cross-section view of the submunition of FIG. 1A configured with the safe and arm in the armed or locked mode.
Figure 3B:
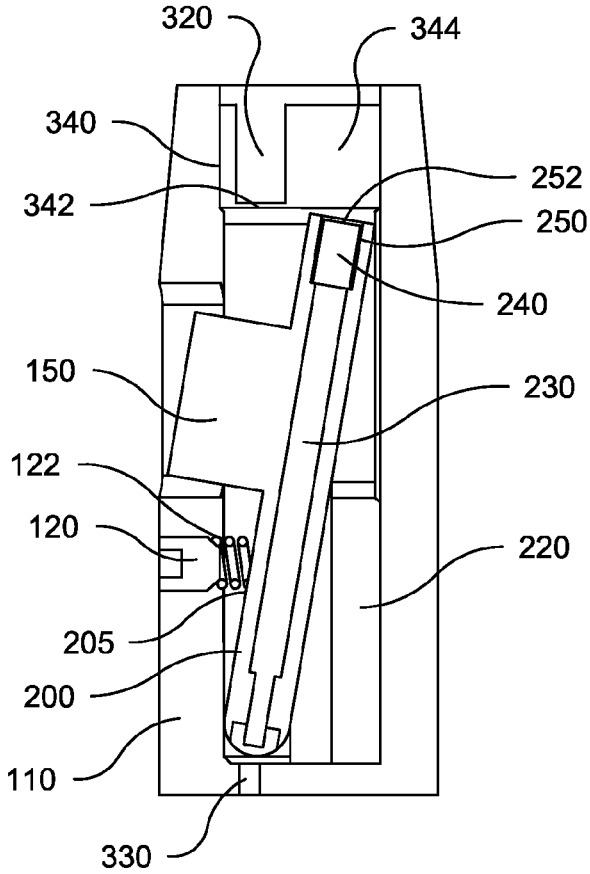
FIG. 3B is a diagram showing another cross-section view of the submunition of FIG. 1A configured with the safe and arm in the armed or locked mode.

FIG. 3A and FIG. 3B are diagrams showing a cross-section view of the submunition 1 configured with the safe and arm pendulum 200 in the safe or locked mode. There may be two conditions that cause the safe and arm pendulum 200 to be positioned in the safe or locked mode. Under the first condition, a force, delivered by an external object such as an adjacent submunition 1 (See e.g. FIG. 4), is exerted on the lock indicator 150 of the safe and arm pendulum 200. Under this condition the safe and arm pendulum 200 is rotated to a position whereby the aft end of the safe and arm pendulum 200 that houses the sensitive explosive 240 is out of line with the insensitive explosive material 320.

Under the second condition, the spring lock 120 exerts a spring force on the top surface 205 of the safe and arm pendulum 200 such that the pendulum is similarly rotated to a position whereby the aft end of the safe and arm pendulum 200 housing the sensitive energetic material is out of line with the insensitive explosive material 320. Under either condition the distance/angle between the cup 250 and the insensitive explosive material 320 is large enough to prevent or substantially mitigate the likelihood of accidental detonation of the explosive payload 290. The body 110 also includes a wall 340 that separates the forward chamber of the housing 100 from the aft chamber of the housing 100. The wall 340 has a first section 342, approximately 0.002 inches thick, located between the forward chamber of the housing 100 and the insensitive explosive 320. The first section 342 aides to prevent inadvertent detonation of the high explosive payload 290, but is sufficiently thin to allow a base portion 252 of the cup 250 to propel through the wall 340 when the sensitive explosive element ignites and propels the base 252 of cup 250 aftward toward the first section 342. The wall 340 also has a thicker second section 344, approximately 0.165 inches thick, located between the forward chamber of the housing 100 and the high explosive payload 290. The second section 344 of the wall 340 is sufficiently thick to prevent the base 252 of the cup 250 from propelling through the wall 340 when the sensitive explosive element ignites and propels the base 252 of the cup 250 toward the second section 344. Both the thin first section 342 and the thicker second section 344 may also serve to act as a protective barrier, sealing off the aft chamber of the submunition housing 100 which holds the high explosive payload 290, from the forward chamber of the submunition housing 100 which holds the submunition components involved in the triggering sequence. In this manner, the wall 340 protects the high explosive payload 290 from being charred or damaged prior to detonation.

Figure 3C:
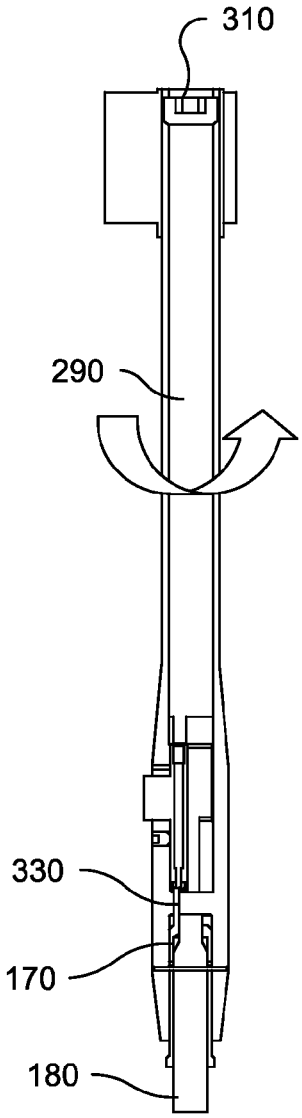
FIG. 3C is a diagram showing a cross-section view of the submunition of FIG. 1A configured with the safe and arm in the safe or unlocked mode.
Figure 3D:
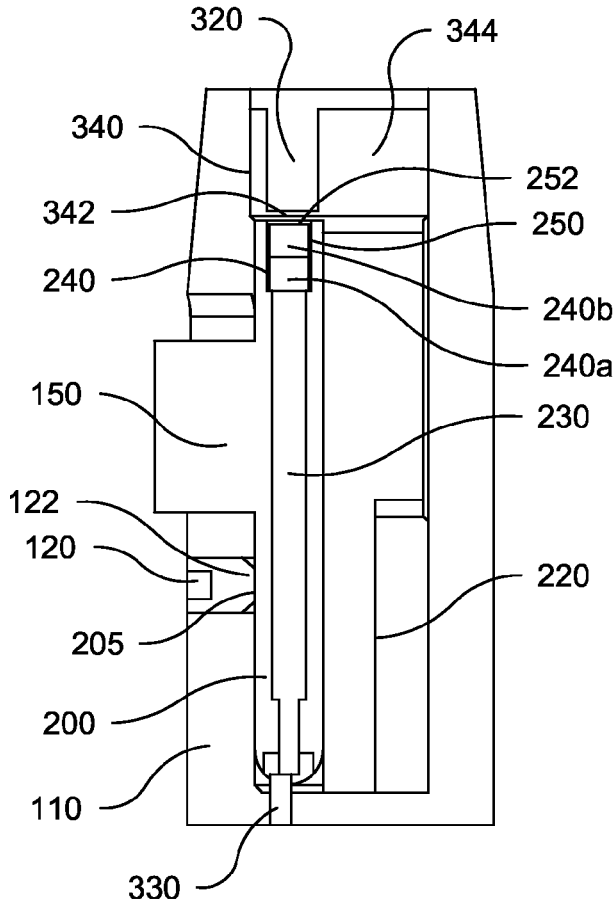
FIG. 3D is a diagram showing another cross-section view of the submunition of FIG. 1A configured with the safe and arm in the safe or unlocked mode.

FIG. 3C and FIG. 3D are diagrams showing a cross-section view of the submunition configured with the safe and arm pendulum 200 in the armed or unlocked mode. In order for the safe and arm pendulum 200 to be in the armed or unlocked mode two unblocking environmental conditions must occur. Each of these environmental conditions independently overcomes one of the previously discussed conditions required for the safe and arm pendulum 200 to be in the safe or locked mode. Under the first environmental condition, the external force exerted on the lock indicator 150 is removed. One exemplary technique for removing an external force is to allow the submunitions to be released from a packaged arrangement 400, such as that shown in FIG. 4. When in free-fall the plurality of submunitions 1 may separate from a bundled packaging 410 as well as from one another. As a result, the external force is removed from the lock indicator 150 and the safe and arm pendulum 200 is free to rotate outward so that the cup 250 may be positioned in line with the insensitive explosive material 320. Under the second environmental condition, the force exerted by the spring lock 120 on the top surface of the pendulum is overcome by an opposing centrifugal force. By way of example, the opposing centrifugal force may be generated by the submunition 1 entering a free-fall spin caused by the offset location of the safe and arm pendulum s center of gravity. Once the centrifugal force overcomes the spring force of the spring lock 120 the safe and arm pendulum 200 may be forced to rotate outward so that the cup 250 may be positioned in line with the insensitive explosive material 320. When both of these environmental conditions occur, the distance/angle between the cup 250 and the insensitive explosive material 320 is sufficiently small to allow detonation of the explosive payload 290.

Figure 4:
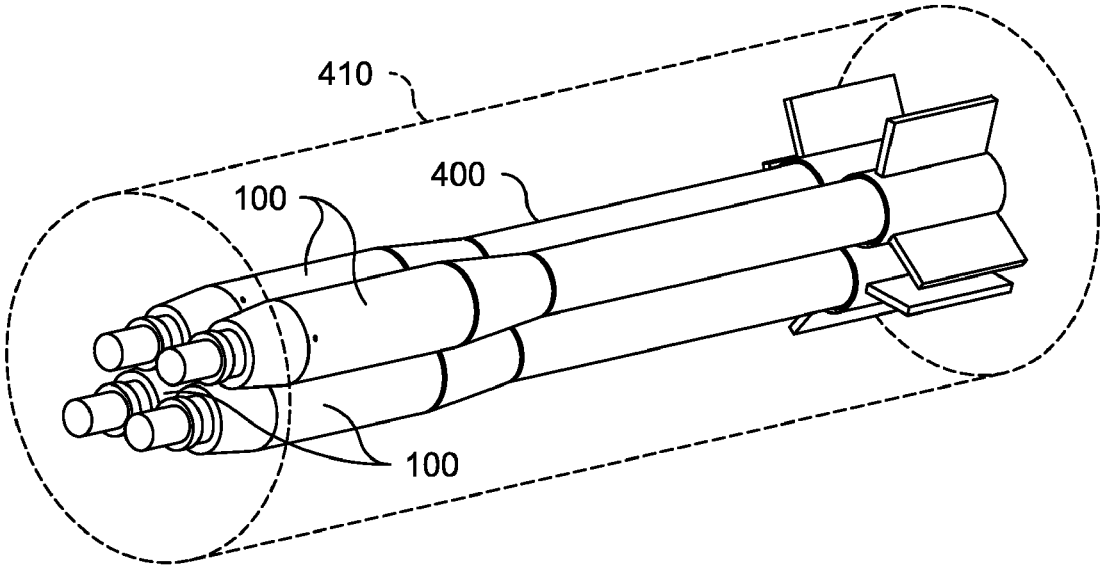
FIG. 4 is a diagram showing a perspective view of the submunitions packaged in a packing arrangement in accordance with an embodiment of the invention.

FIG. 4 illustrates an exemplary configuration wherein a plurality of submunitions 1 are provided in a packaged arrangement 400 within a bundled packaging 410 in such a way that the lock indicator 150 of each submunition is held down by either the surface of the submunition housing 100 of an adjacent submunition 1 or an interior surface of the bundled packaging 410 within which the submunitions are housed. In an exemplary embodiment the bundled packaging 410 may be a dispenser storing many thousands of submunitions 1. The dispenser may be configured to be released from a plane or other airborne vehicle. Prior to release both of the safe and arm locking mechanisms are in place (see e.g. FIG. 3A) since the external indicator lock is held down and there is no centrifugal force acting on the spring lock 120. Subsequent to release, the dispenser may be configured to petal open, releasing the bundled submunitions in free fall. When in free-fall the plurality of submunitions 1 may separate from the bundled packaging 410 as well as from one another. As a result, the external force is removed from the lock indicator 150 and the safe and arm pendulum 200 is free to rotate outward so that the cup 250 may be positioned in line with the insensitive explosive material 320. Once separated, the individual submunitions also begin a free-fall spin as a result of the offset location of the safe and arm pendulum s center of gravity. As a result, the force exerted by the spring lock 120 on the top surface 205 of the safe and arm pendulum 200 is overcome by an opposing centrifugal force caused by the free-fall spin. Once the centrifugal force overcomes the spring force of the spring lock 120 the safe and arm pendulum 200 is forced to rotate outward so that the cup 250 and the insensitive explosive material 320 may be positioned in line (see e.g. FIG. 3B). When both of these environmental conditions occur, the distance/angle between the cup 250 and the insensitive explosive material 320 is sufficiently small to allow detonation of the explosive payload.

As a result the submunitions of the present embodiment are only armed or unlocked when they are both separated from their packaging and while spinning in freefall. This configuration provides the submunition 1 with the desired environmentally-derived safe and arm with two independent locks.

Reactive Nano-Coated Rod Delay

Figure 5:
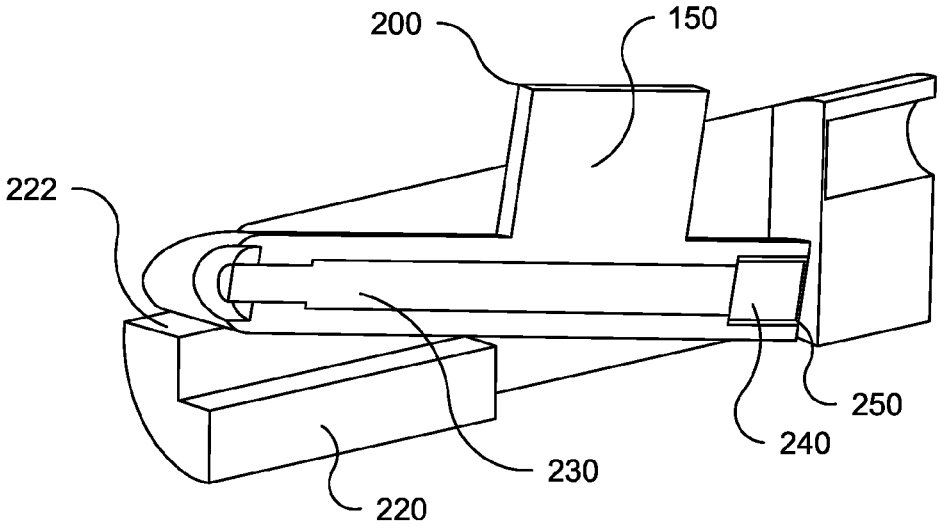
FIG. 5 is a diagram showing a cross-section view of a safe and arm and timer delay mechanism in accordance with an embodiment of the invention.

Through continued effort to improve mine-defeating submunitions applicant has recognized that existing delay mechanisms fail to provide an appropriate micro-second time delay for mine-defeating applications and are not sized to fit within small-scale submunition housings. In order to ensure destruction of a mine, the explosive payload of the submunition 1 must be detonated while intimately coupled with the energetic fill of the mine. As a result, the time delay between mine lid impact and explosion of the explosive payload falls within the microsecond scale and must be precisely controlled. By way of example, the time delay may be approximately 400 to 600 microseconds. Existing delay mechanisms are also not sized to fit within a submunition housing of the desired scale (inner diameter of approximately ¼ inch or less). To overcome this problem an alternate solution is contemplated that integrates the rod delay 230 having a reactive coating within the safe and arm pendulum 200. FIG. 5 shows a cross-section of the integrated safe and arm pendulum 200 and rod delay 230. Also housed within the safe and arm device are the sensitive explosive 240 and the cup 250.

Figure 6:
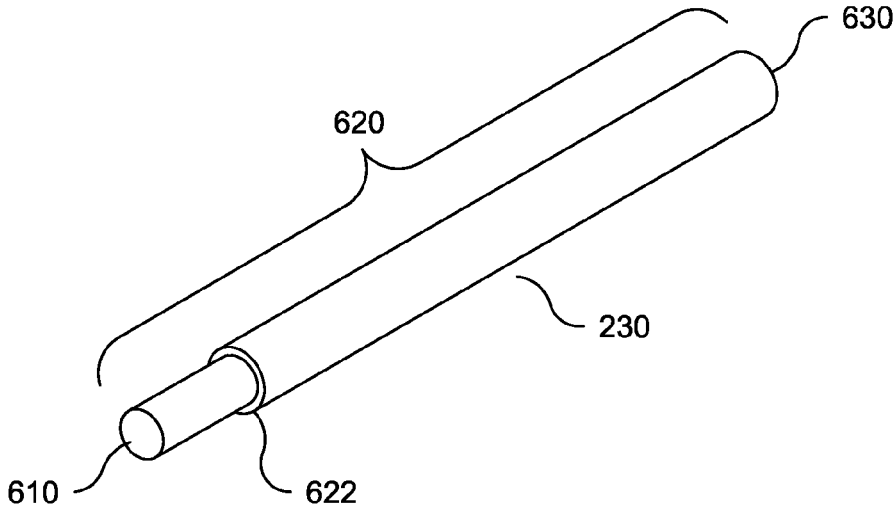
FIG. 6 is a diagram showing a perspective view of a rod delay mechanism in accordance with an embodiment of the invention.

Referring now to FIG. 6, the rod delay 230 is comprised of an impact-sensitive end 610 coated with a reactive material adjusted to be highly sensitive to a kinetic impact, a cylindrical outer surface 620 also coated with a reactive material, and a second end 630 having a thermite coating. The rod delay 230 also has a shoulder labeled as 622 for preventing the impact-sensitive end 610 from prematurely impacting the firing pin 330 (see, e.g. FIG. 3B). By way of example, the rod delay 230 may be comprised of S-7 tool steel. The rod delay may have a length equal to or less than approximately 0.65 inches. The reactive coatings are applied by sputter-coating or similar methods. The reactive material used in the preferred embodiment is a reactive nano-coating material developed by Reactive NanoTechnologies (RNT) and sold under the trademark NANOFOIL®. This reactive material is currently used in joining applications, such as for fusing together metal components. Use of such a reactive material provides the desired microsecond-scale reactive time delay and is a new application. It is to be understood that any reactive coating that provides such a microsecond time delay may be employed. It is also noted that the delay time may be modified by utilizing faster or slower reactive nano-coating burn rate materials. To accommodate a faster burning nano-reactive material the length of the rod delay 230 may be decreased. In such an embodiment, the length of the pendulum 200 could be maintained to assure appropriate inertial arming forces are generated. To initiate the sensitive explosive 240, the resulting gap between the delay rod 230 and the sensitive explosive 240 may be filled with a detonating cord which burns at detonation velocities of approximately 1 to 7 kilometers per second.

Referring back to FIG. 3C and FIG. 3D, the triggering sequence is enabled when the distance/angle between the cup 250 and the insensitive explosive material 320 is sufficiently small to allow detonation of the explosive payload. After mine impact the shear pin 210 is defeated causing firing pin 330 to be forced aftward. Once the firing pin 330 breaks through and impacts the impact-sensitive end 610 the reactive coating on the impact-sensitive end 610 sparks. This spark in turn causes the reactive coating on the cylindrical surface 620 to ignite and propagate longitudinally from the impact-sensitive end 610 to the second end 630. Once second end 630 is reached the thermite coating on second end 630 is ignited resulting in the subsequent ignition of the sensitive explosive 240. Ignition of the sensitive explosive 240 causes the base 252 of the cup 250 to fracture from its main body. This causes the base 252 to act as a flyer plate that propels through the first section 342 of wall 340 with sufficient kinetic energy to shock initiate the insensitive explosive material 320 thus detonating the high energy payload/explosive pellets 290. By way of example, the cup base 252 may have a thickness of approximately 0.005 inches. In the exemplary embodiment of FIG. 3B the sensitive explosive 240 may further comprise a sensitive low-energy material 240*a* such as Lead Azide (detonation velocity of approximately 1 km/sec), as well as a second higher-energy booster material 240*b* such as PBXN-301 (detonation velocity of approximately 3 km/sec). The booster material 240*b* propels the base 252 of the cup 250 with sufficient kinetic energy to initiate detonation of the high explosive payload 290.

It is to be understood that the triggering mechanism 160 is configured in such a way as to prevent detonation unless impacting a rigid structure such as a land mine. Detonation does not occur while traveling through media such as air, water and sand due to an insufficient opposing force on the triggering sleeve 170.

Referring back to FIG. 3A and FIG. 3B, the triggering sequence is disabled when the distance/angle between the cup 250 and the insensitive explosive material 320 is sufficiently large that detonation of the explosive payload 290 is disabled. Under this condition the triggering sequence halts at the point when the sensitive explosive 240 ignites causing the base 252 of the cup 250 to fracture from its main body. This causes the base 252 to act as a flyer plate that propels aftward toward the second section 344 of the wall 340. In this situation, the cup 250 is not lined up with the insensitive explosive material 320 and the second section 344 of the wall 340 is also sufficiently thick to prevent the base 252 of the cup 250 from entering the aft chamber of the housing 100. Therefore insufficient kinetic energy exists to shock initiate the insensitive explosive material 320 and the high payload/explosive pellets 290 do not detonate.

Thus, a submunition has been described by means of example and not limitation that provides an appropriate micro-second time delay for mine-defeating applications as well as the desired reduction in scale. The submunition includes a safe and arm pendulum mechanism having an integrated rod delay with a reactive coating. The safe and arm pendulum mechanism may also provide independent locks which are to be unblocked (e.g. via environmental conditions) in order to arm the submunition. The safe and arm pendulum may further include a lock indicator and is held in a safe mode position by an internal spring lock or external force acting on the lock indicator. The spring lock may be overcome by a centrifugal force associated with free-fall spinning of the submunition. The external force may be overcome by removal of the submunition from an external packaging environment.

While the foregoing describes exemplary embodiments and implementations, it will be apparent to those skilled in the art that various modifications and variations can be made to the present invention without departing from the spirit and scope of the invention.

What is claimed is:

1. A submunition comprising:

a submunition body;

an explosive payload housed within said submunition body;

an elongated delay member housed within said submunition body, the elongated delay member coated with at least one reactive material that provides a controlled time delay between submunition impact and detonation of the explosive payload; and an elongated pendulum having a hollow core sized to receive said elongated delay member, the elongated pendulum adapted to be movable between a first position for mitigating likelihood of inadvertent detonation of the explosive payload and a second position for enabling detonation of the explosive payload, the elongated pendulum being substantially out of line with a longitudinal axis of the submunition when in the first position and substantially in line with a longitudinal axis of the submunition when in the second position.

2. The submunition of claim 1, wherein the first position is a locked position and the second position is an unlocked position.

3. The submunition of claim 2, further comprising a spring lock mounted within the body of the submunition, the spring lock having a spring adapted to exert a spring force on a top surface of said elongated pendulum, the spring force causing said elongated pendulum to rotate to said locked position.

4. The submunition of claim 3, further comprising a lock indicator protruding from a top surface of the elongated pendulum, the lock indicator sized to protrude partially through a slot disposed along the submunition body, wherein an external force applied to said lock indicator causes said elongated pendulum to rotate to said locked position.

5. The submunition of claim 4, wherein the elongated pendulum is adapted to rotate to the unlocked position when said external force is removed from said lock indicator and when a centrifugal force overcomes said spring force.

6. The submunition of claim 4, further comprising:

a forward chamber and an aft chamber, said forward chamber and said aft chamber being separated by a wall, the elongated pendulum being housed within said forward chamber;

a sensitive explosive element housed within said elongated pendulum and positioned substantially aft of said elongated delay member;

a cup element housed within said elongated pendulum, said cup element enclosing an aft end of said sensitive explosive element;

an insensitive explosive material housed within said aft chamber, said insensitive explosive material adapted to ignite upon receipt of a kinetic impact from said cup element;

wherein the explosive payload is housed within said aft chamber and positioned substantially aft of said insensitive explosive material, said explosive payload adapted to detonate upon ignition of said insensitive explosive material.

7. The submunition of claim 6, wherein the elongated delay member is positioned substantially out of line with the insensitive explosive element when said elongated pendulum is rotated to said locked position and wherein the elongated delay member is positioned substantially in line with said insensitive explosive element when said elongated pendulum is rotated to said unlocked position.

8. The submunition of claim 7, wherein the elongated pendulum has at a first end at least one transverse protrusion and the projectile further comprises a pendulum housing, said pendulum housing sized to fit within said forward chamber and having a cutout section shaped to receive said elongated pendulum and to allow said transverse protrusion of said elongated pendulum to rotate about one end of the pendulum housing.

9. The submunition of claim 6, wherein the wall that separates the forward chamber and the aft chamber further comprises a first section adjacent to said insensitive explosive material and a second section adjacent to said explosive payload, the second section being thicker than the first section.

10. The submunition of claim 9, wherein the first section of the wall is adapted to allow said cup element to propel through the wall when said sensitive explosive element ignites and propels said cup toward said first section of the wall.

11. The submunition of claim 10, wherein the second section of the wall is adapted to prevent said cup element from propelling through the wall when said sensitive explosive element ignites and propels said cup toward said second section of the wall.

12. The submunition of claim 6, wherein the elongated delay member further comprises:

a forward end coated with a first reactive material, the first reactive material adapted to ignite upon receipt of a kinetic impact from a triggering mechanism;

an aft end having a thermite coating; and an elongated section coated with a second reactive material, the second reactive material adapted to burn longitudinally from said forward end to said aft end upon said forward end receiving said kinetic impact from the triggering mechanism.

13. The submunition of claim 12, wherein the first and second reactive materials are reactive nano-coating materials.

14. The submunition of claim 12, wherein the thermite coating of the aft end of said elongated delay member is adapted to ignite said sensitive explosive element and wherein upon ignition said sensitive explosive element is adapted to propel said cup towards said aft chamber.

15. The submunition of claim 2, wherein the elongated delay member is adapted to cause a delay in detonation of the explosive payload of approximately 400 to 600 microseconds.

16. The submunition of claim 15, wherein the submunition body has an inner diameter equal to or less than approximately 0.25 inches and a length equal to or less than approximately 6 inches.

* * * * *